US005460552A

United States Patent [19]

Blanchard et al.

[11] Patent Number: 5,460,552

[45] Date of Patent: Oct. 24, 1995

[54] ADAPTOR PLATE MOUNTING SYSTEM FOR MARINE JET PROPULSION UNIT

[75] Inventors: Clarence E. Blanchard, Kenosha, Wis.; Edward K. Lam, Wadsworth, Ill.

[73] Assignee: Outboard Marine Corporation, Waukegan, Ill.

[21] Appl. No.: 147,880

[22] Filed: Nov. 5, 1993

[51] Int. Cl.[6] ..... B63H 21/30

[52] U.S. Cl. ..... 440/38; 440/52; 440/111

[58] Field of Search ..... 440/111, 52, 40–43, 440/38; 248/638

[56] References Cited

U.S. PATENT DOCUMENTS

| | | | |
|---|---|---|---|
| 2,740,368 | 4/1956 | Irgens et al. | 248/638 X |
| 4,194,460 | 3/1980 | Sato et al. | 285/236 |
| 4,239,013 | 12/1980 | Haynes | 440/40 |
| 4,303,401 | 12/1981 | Sanmi et al. | 440/88 |
| 4,457,724 | 7/1984 | Miyamoto | 440/38 |
| 4,765,075 | 8/1988 | Nakase et al. | 440/38 |
| 4,768,983 | 9/1988 | Smith | 440/111 |
| 4,813,898 | 3/1989 | Nakase et al. | 440/111 |
| 5,025,762 | 6/1991 | Gohara et al. | 123/196 S |
| 5,237,950 | 8/1993 | Abe et al. | 114/270 |

OTHER PUBLICATIONS

Installation Manual, "Sport Jet 90", Brunswick Corporation, 1993, pp. 1–24.

*Primary Examiner*—Sherman Basinger
*Attorney, Agent, or Firm*—Greer, Burns & Crain, Ltd.

[57] ABSTRACT

A mounting system for connecting a marine power head having a vertically disposed crankshaft to a jet propulsion unit for isolating operational vibrations includes an adaptor plate, a power head mounting apparatus on the adaptor plate for securing the power head to the plate, and a connecting assembly for connecting the adaptor plate to the jet propulsion unit at at least one point, the connecting assembly including resilient portions to isolate vibrations generated by the power head.

17 Claims, 3 Drawing Sheets

104
102
100
98
106
108
92
92
94
94
P
95
78
112
20
79
110
84
86
90
112
80
90
84
86
88
88
79
96
72
76
74
120
114
116
118
122
82
128
94
95
130
133
132
94
134
48
40
136
44
140
109
95
142
94
92
138
38
146
144
140
36
42
14
56
154
58
52
150
148
56

ADAPTOR PLATE MOUNTING SYSTEM FOR MARINE JET PROPULSION UNIT

RELATED APPLICATIONS

This application is related to commonly-assigned applications entitled: MARINE PROPULSION UNIT HAVING EXTERIORLY ACCESSIBLE CLEAN-OUT CAPABILITY AND FLUSHING DEVICE FOR SAME, Ser. No. 08/147,976 filed Nov. 5, 1993, JET PUMP MOUNTING SYSTEM, Ser. No. 08/147,933, filed Nov. 5, 1993, and JET PUMP EXHAUST SYSTEM, Ser. No. 08/147,973, filed Nov. 5, 1993, and now abandoned.

BACKGROUND OF THE INVENTION

The present invention relates generally to marine jet propulsion units, and specifically to relatively higher-powered, inboard mounted marine jet propulsion units having indirect drive systems, and designed for installation in conventional, multipassenger watercraft.

Conventional marine jet propulsion units are intended to replace propeller driven outboard or inboard marine motors. Some of the more significant advantages of jet propulsion units include the lack of a depending gear case, which allows the craft to make tight turns while maintaining the boat in a generally horizontal or level orientation. Another feature of marine jet propulsion units is that the lack of a depending propeller enables the craft to be operated in shallower water without fouling.

An important design consideration of marine jet propulsion units is that operational vibrations should be minimized or eliminated as much as possible to make boating in a watercraft powered by such a unit as pleasant an experience as possible. Unwanted vibrations in such units are generated by two main sources, the power head and the jet pump, the latter component enclosing the transmission which emits vibration from the gears.

Accordingly, a first object of the present invention is to provide a marine jet propulsion unit wherein a significant proportion of operational Vibrations are absorbed instead of being transmitted to the watercraft.

Another object of the present invention is to provide a mounting system for a marine jet propulsion unit including a power head having a vertical crankshaft and a pump unit, wherein the power head is vibrationally isolated from the pump unit.

Yet another object of the present invention is to provide a marine jet propulsion unit wherein power head vibrations are absorbed prior to transmission to the pump unit.

SUMMARY OF THE INVENTION

Accordingly, the above-identified objects are met or exceeded by the present mounting system for a marine jet propulsion unit, including an adaptor plate providing a mounting point for the power head and attached to the pump housing by resilient bushings for absorption of unwanted vibration. The number and placement of the bushings is designed to optimize absorption of vibrations. An additional feature of the present adaptor plate is that it also serves as a portion of the exhaust housing of the jet propulsion unit.

More specifically, a mounting system for connecting a marine power head having a vertically disposed crankshaft to a jet propulsion unit for isolating operational vibrations includes an adaptor plate, a power head mounting apparatus on the adaptor plate for securing the power head to the plate, and a connecting assembly for connecting the adaptor plate to the jet propulsion unit at at least one point, the connecting assembly including resilient portions to isolate vibrations generated by the power head.

In another embodiment, an adaptor plate is for use in coupling a marine power head to a jet propulsion pump unit having a fore end and an aft end. The adaptor plate has a fore end corresponding to the fore end of the pump unit, an aft end corresponding to the aft end of the pump unit, and an attachment point for receiving the power head. A pair of first adaptor plate mounting brackets are disposed in spaced relationship along one of the fore and aft ends of the plate, at least one second adaptor plate mounting bracket is displaced from the first mounting brackets toward the end of the pump unit opposite the end at which the first brackets are located. Resilient bushings are provided which are attachable to the first and second adaptor plate mounting brackets for connection of the adaptor plate to the pump housing. Upon the attachment of the power head to the adaptor plate, and the attachment of the adaptor plate to the pump unit, vibrations generated by the power head are absorbed by the bushings and isolated from the pump unit.

In the preferred embodiment of the present adaptor plate, the front pair of mounting brackets are angled such that their longitudinal axes intersect at or above a horizontal line extending fore and aft of the center of gravity of the vibrating body or power head. Further, it has been found that the optimal positioning of the bushings results when vectors representing the coefficient of elasticity of the two front bushings intersect at a point at or about the center of gravity of the power head. This orientation has been found to optimize vibration reduction from the power head.

DESCRIPTION OF THE PREFERRED EMBODIMENT

Figure 1:
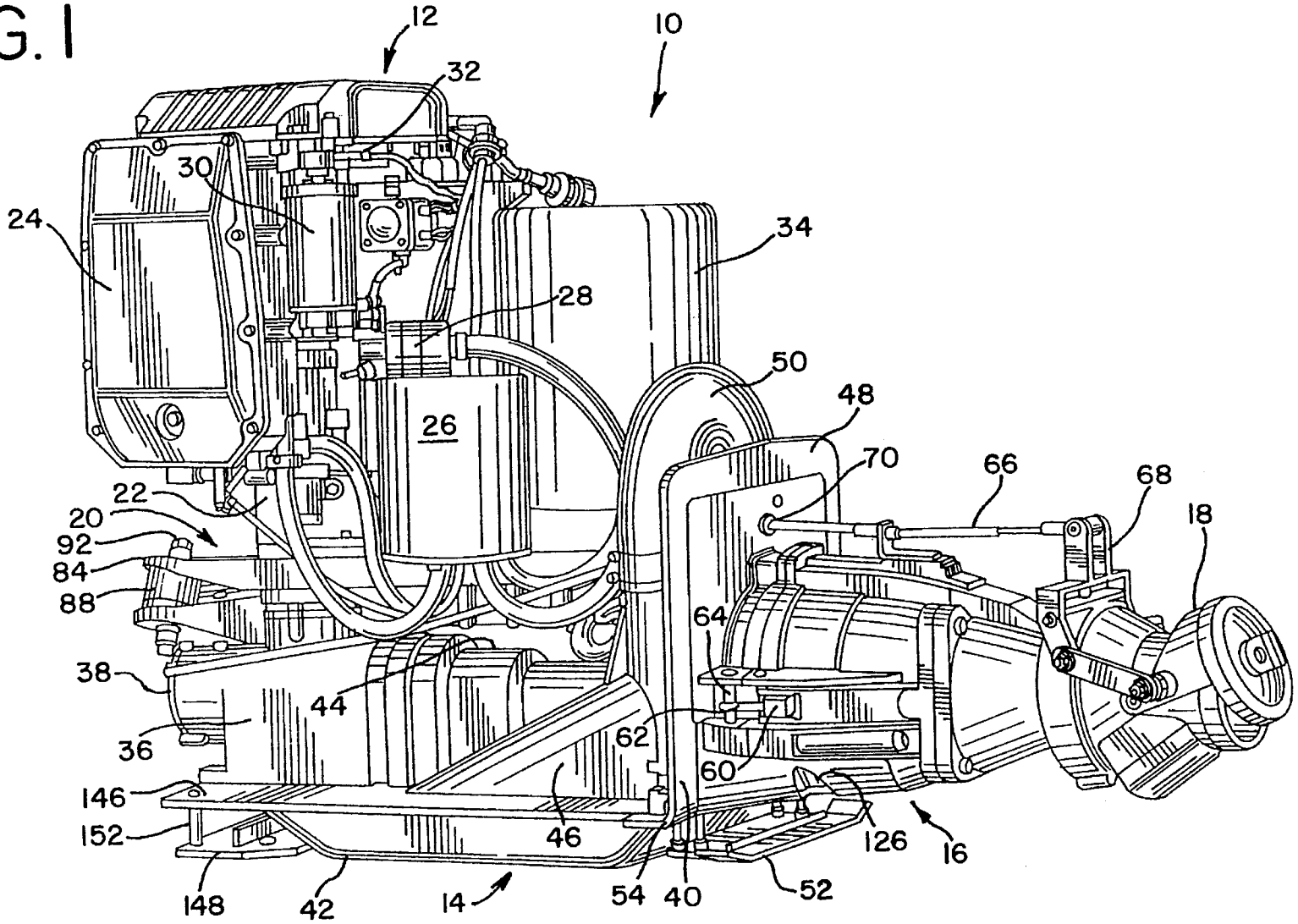
FIG. 1 is a side perspective view of a marine power head and jet pump assembly employing the present adaptor plate.

Referring now to FIG. 1, a marine jet propulsion unit of the type suitable for use with the present adaptor plate is generally designated 10. The unit 10 is designed for being mounted in inboard fashion into the hull of a watercraft, preferably a multi-passenger boat. However, the use of the present propulsion unit with other watercraft is contemplated. Major components of the propulsion unit 10 are a power head or engine 12, a pump unit 14, an impeller housing 16, a reverse gate 18 connected to the impeller housing 16, and the present adaptor plate 20 disposed between the power head 12 and the pump unit 14.

The power head 12 in the preferred embodiment is a conventional three cylinder, two-cycle marine power head including an engine block 22, an air silencer device 24, a fuel pump 26, a fuel filter 28 connected to the fuel pump, an electric starter 30 connected to a flywheel assembly 32, and a muffler 34. In the preferred embodiment, the power head 12 is capable of generating in the range of 70–90 horsepower, although power heads of both smaller and larger power ratings are suitable for use with the present adaptor plate 20.

Referring now to the pump unit 14, the unit includes a housing 36, also referred to as a gear housing, having a fore end 38, an aft end 40, an underside 42 and an upper surface 44. Included in the underside 42 is a water intake grille (not shown) which is in fluid communication with a water intake conduit 46. At the aft end 40 is found a transom plate 48 which is integrally formed with the housing 36, as by casting, and an exhaust hose 50. A ride plate 52 is located on the underside 42 of the housing 36, in vertically spaced, depending relationship relative to a lower end 54 of the transom plate 48. A portion of the hull 56 of the watercraft to which the present unit 10 is mounted is sandwiched between a portion of the ride plate 52 and the underside 42 of the housing 36. If desired, a sacrificial anode 58 may be mounted to the ride plate 52 (best seen in FIG. 2).

The impeller housing 16 is releasably connected to the gear housing 36 by a pair of diametrically opposed clips 60 which each include a hook portion 62 constructed and arranged to engage a post 64 secured to an aft end of the transom plate 48. A gear shift cable 66 is connected to the reverse gate 18 through a linkage 68 and passes through a grommeted aperture 70 in the transom plate 48.

Figure 2:
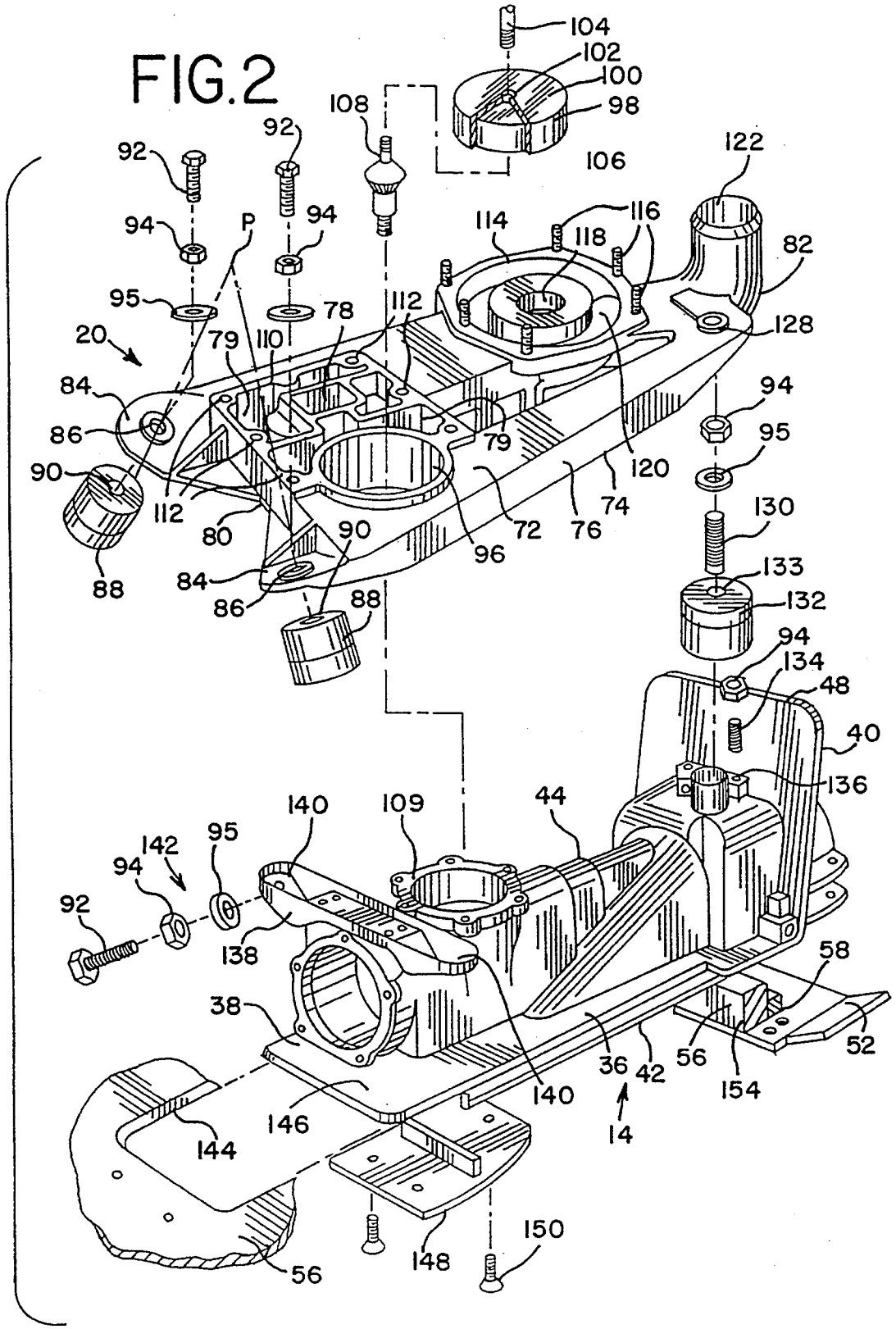
FIG. 2 is an exploded perspective elevational view of the present adaptor plate and the pump housing of the assembly of FIG. 1.

Referring now to FIG. 2, the adaptor plate 20 is shown exploded away from the impeller housing 16. Although having a generally planar or relatively flattened configuration, the adaptor plate 20 is basically a cast hollow component, having a generally planar upper surface 72, a lower surface 74 and a sidewall 76. The sidewall 76 defines an internal space or passageway 78 and maintains the lower surface 74 in vertically spaced relationship from the upper surface 72. It will be appreciated that the power head 12 and the adaptor plate 20 are cooled by circulating ambient water, and that the adaptor plate 20 is in fluid communication with the cooling galleries of the power head 12 through passageways 79 which are disposed about the passageway 78.

Included on the plate 20 is a fore end 80 and an aft end 82 corresponding to the fore and aft ends 38, 40 of the gear housing 36. At the fore end 80 of the plate 20 are located a pair of mounting ears 84, each provided with a throughbore 86, and each ear and throughbore form an adaptor plate mounting bracket. Each of the ears 84 are preferably disposed at an angle to the horizontal plane to define a "V-shape" when the plate 20 is viewed from the fore end 80. Thus, when viewed from the fore end 80, an outer edge of each of the mounting ears 84 is angled upwardly from the horizontal.

An elastomeric, resilient bushing 88 is provided for each of the mounting ears 84. Each bushing 88 is basically cylindrical in shape and has an internally threaded upper sleeve 90 and a corresponding lower sleeve (not shown). The upper and lower sleeves are not in contact with each other. A threaded fastener 92, a locknut 94 and a washer 95 are employed to engage the corresponding sleeve 90 to lockingly secure each bushing 88 to a corresponding one of the ears 84.

Moving toward the aft end 82, the plate 20 further includes a generally vertically oriented transmission throughbore 96 dimensioned to accommodate an elastomeric drive couplers 98 having an open-bottomed metallic shell with a threaded upper aperture 102 for receiving a power head drive shaft or crankshaft 104 in positive engagement. It is noteworthy here that the present unit 10 is used with power heads 12 having vertically oriented crankshafts 104, as opposed to conventional, generally horizontally oriented crankshafts.

At a second or bottom end 106, the coupler 98 is provided with an elastomeric core which is secured within the metallic shell, and is configured to drivingly accommodate a corresponding end of a splined shaft 108. Since the coupler 98 is of the type having a resilient rubber-like core, it further isolates the gear housing 36 from power head vibrations. Thus, power in the form of rotational energy from the power head 12 is transmitted through the drive shaft 104, through the resilient core of the coupler 98 and through the shaft 108.

The drive coupler 98 is in substantial registry with an upper opening 109 of the gear housing 36 into which the gear shaft 108 projects for engagement with the coupler. For vibration dampening, the coupler 98 does not contact, but merely is disposed in, the upper opening 109. A main impeller drive shaft (not shown) is connected to the shaft 108 and transmits the rotational energy to the impeller housing 16.

Adjacent the transmission throughbore 96 is a crankcase mounting point 110 configured to receive the power head 12. The mounting point 110 is the surface which surrounds the passageways 78, 79 and the throughbore 96. The power head 12 is secured to the plate 20 by threaded fasteners (not shown) which engage a plurality of mounting apertures 112 on the mounting point 110. The mounting point 110 is in fluid communication with the passageway 78 through a port at the end of passageway 78 which is surrounded by the mounting point 110 (as shown in FIG. 2) so as to receive exhaust gases emitted by the power head 12.

Further towards the aft end 82 is located a muffler attachment surface 114 which includes a plurality of attachment studs 116, a centrally located exhaust outlet 118 in communication with the power head 12 through the passageway 78, as defined by the hollow interior of the adaptor plate 20, and a peripherally disposed exhaust inlet 120. Exhaust gases enter the muffler 34 from the outlet 118, and are emitted from the muffler into the inlet 120. An exhaust conduit 122 located at the aft end 82 receives muffled exhaust from the exhaust inlet 120, and is in turn connected to the flexible exhaust hose 50 (best seen in FIG. 1) which ultimately passes exhaust out the ports 126 (FIG. 1). The exhaust hose 50 is made of resilient materials for enhanced isolation of vibrations.

Adjacent the exhaust conduit 122 is located a third adaptor plate mounting bracket 128 which is basically a throughbore into which a set screw 130 or similar fastener is secured with a locknut 94 and a washer 95. A rear bushing 132 is secured at a first end to the set screw 130 in similar fashion as the bushings 88 are secured to the plate 20. At the opposite end of the bushing 132, a threaded stud 134 is engaged in the bushing 132 and is locked with a locknut 94 to a threaded boss 136 on the gear housing 36.

At the fore end 80 of the plate 20, the bushings 88 are secured to the gear housing 36 by an engine mount arm 138 fixed to the fore end of the housing and having an opposed pair of angled pockets or seats 140. Each seat 140 is dimensioned to accommodate one of the bushings 88, which is secured therein by a threaded fastener and locknut assembly 142. Each bushing 88 is thus disposed between the fore motor mount brackets or ears 84 and one of the bushing pockets 140. Similarly, the rear bushing 132 is retained between the adaptor plate 20 and the gear housing 36. Optimally, the longitudinal axis of the rear bushing 132 will also be directed at the center of gravity of the power head 12. However, manufacturing constraints and the presence of other components may impede this arrangement.

Once the power head 12 is installed upon the adaptor plate 20, which in turn is mounted to the gear housing 36, the unit 10 is ready for mounting to the hull 56. Marine vessels of the type designed for jet propulsion units such as the unit 10 normally have an opening 144 cut or molded into the hull 56. The unit 10 is set into the opening 144 so that a lower flange 146 of the gear housing rests upon the hull adjacent the opening. In some portions of the opening, a clamping plate, such as the pump hold down clamp plate 148 is employed to sandwich the hull 56 between the clamp 148 and the gear housing 36.

In the preferred embodiment, threaded fasteners 150 inserted into rigid sleeves 152 (best seen in FIG. 1) are used to secure the clamp plate 148 to the housing 36 through the hull 56. The sleeves 152 prevent the fasteners from crushing the hull 56, which in most cases is fiberglass or similar material. However, it is also contemplated that other fastening arrangements may be employed for securing the unit 10 to the hull 56. If desired, this type of joint may be sealed with marine caulk or adhesive (not shown).

At the aft end 40 of the gear housing 36, the ride plate 52 is employed to sandwich another portion of the hull 56 between the ride plate 52 and the gear housing 36. A portion of the hull 56 clamped in this manner is indicated at 154.

Figure 5:
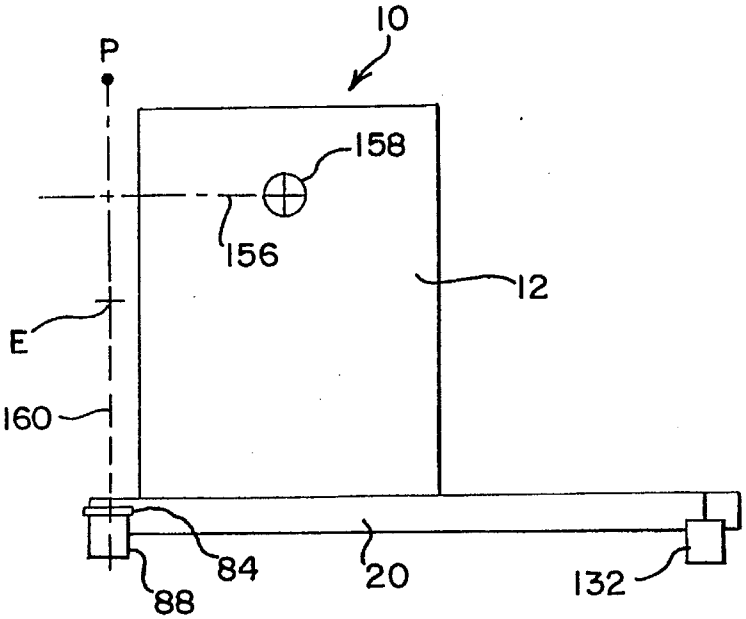
FIG. 5 is a fragmentary schematic representation of a side view of the propulsion unit of FIG. 3.
Figure 4:
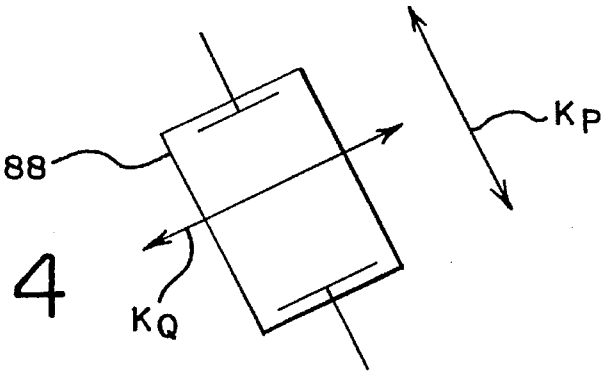
FIG. 4 is a schematic force diagram depicting the vector forces of elasticity of a typical resilient bushing suitable for use with the present adaptor plate.
Figure 3:
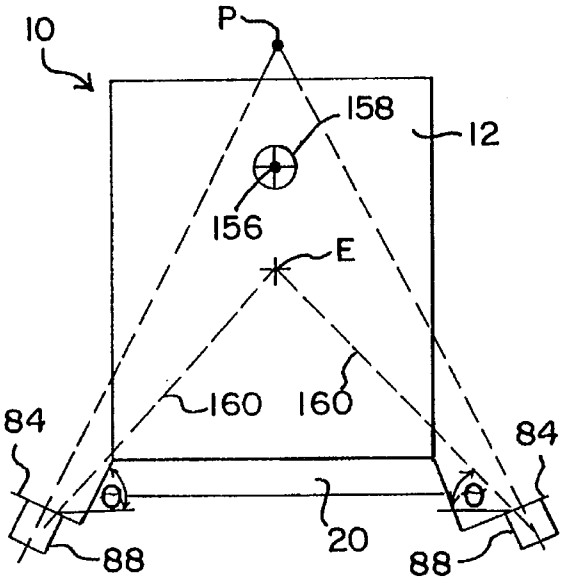
FIG. 3 is a fragmentary schematic representation of a front view of the present jet propulsion unit illustrating the optimal positioning of the resilient bushings.

Referring now to FIGS. 3–5, which are schematic representations of portions of the jet propulsion unit 10, it will be noted that once the fore end bushings 88 are attached to the corresponding ears 84, the inclination of the ears is such that longitudinal axes of the bushings 88 intersect at a point P. The point P is above a horizontal line 156 extending fore and aft from the center of gravity 158 of the power head 12. In one embodiment, the point P is also located in front of the center of gravity 158 (best seen in FIG. 5).

It has been found that to optimize absorption of power head vibrations, not only the angular orientation, but the elasticity of the bushings 88 should be considered. Each bushing 88 has an axial elasticity component, designated kp, and a transverse or lateral elasticity component, designated kq. For most bushings of the type used for power head or other engine mounts, kp is relatively stiffer than kq. The relationship of these factors, referred to as the stiffness ratio or the coefficient of elasticity, is expressed as the ratio of kp/kq. A preferred stiffness ratio is greater than 1:1, and in the present embodiment is approximately 7:1.

A vector representation of the stiffness ratio for each of the bushings is indicated in FIG. 3. It will be seen that the axis of elasticity 160 of each of the two fore end bushings 88 forms an angle θ, and the two axes 160 intersect at point E which is the center of elasticity. The center of elasticity E is below the point P and is at, about or generally horizontally aligned with the center of gravity 158 of the power head 12. It is contemplated that the point E may also be located below the center of gravity in a vertical plane located forward of the power head 12.

In order to maintain point E in the desired position, the point P of intersection of the longitudinal axes of the bushings is consequently placed above the center of gravity 158. The mounting ears 84 of the adaptor plate 20 are appropriately angled to achieve this relationship. With such an angled orientation in the mounting of the power head 12 to the gear housing 36, a significant amount of the engine vibrations are absorbed by the bushings 88 and isolated from the gear housing and ultimately, the hull 56.

It has been found that the power head 12 generates relatively fewer fore-to-aft vibrations compared to side-to-side vibrations. As such, the rear bushing 132 may be disposed in a vertical rather than an inclined or angled orientation, as are the bushings 88. In embodiment of the jet propulsion unit 10 depicted in FIGS. 1 and 2, the vertical orientation of the bushing 132 facilitates manufacturing.

Once the jet unit 10 is installed in the hull of a marine craft, a major advantage of the present adaptor plate 20 is that vibrations generated by the power head 12 are absorbed by the bushings 88 and 132 before being transmitted through the gear housing, and ultimately through the hull. Improved isolation of power head vibrations has been realized when two bushings 88 located at the fore end 38 of the gear housing 36 are oriented so that the longitudinal axes of the bushings intersect above the center of gravity of the power head 12. In this orientation, the center of elasticity may be located at or about the center of gravity. Another feature of the present adaptor plate 20 is that it has a dual function of serving as an exhaust conduit between the power head 12 and the muffler 34.

While a particular embodiment of the adaptor plate mounting system for marine jet propulsion unit of the invention has been shown and described, it will be appreciated by those skilled in the art that changes and modifications may be made thereto without departing from the invention in its broader aspects and as set forth in the following claims.

What is claimed is:

1. A mounting system for connecting a marine power head having a vertically disposed crankshaft to a jet propulsion unit for isolating operational vibrations, comprising:

an adaptor plate having a first surface, a second surface and a passageway defined between said first and second surfaces;

power head mounting means on said adaptor plate for securing the power head to said plate, said power head mounting means including a port in fluid communication with said passageway; and connecting means for connecting said adaptor plate to the jet propulsion unit at at least one point, said connecting means being resilient to isolate vibrations generated by the power head.

2. The mounting system as defined in claim 1 wherein said passageway is in fluid communication with an exhaust system mounted to said plate.

3. The mounting system as defined in claim 1 wherein said connecting means includes at least one resilient bushing configured for attachment to said adaptor plate and to the jet propulsion unit.

4. The mounting system as defined in claim 3 wherein each said bushing has a longitudinal axis, and the longitudinal axes of at least two of said bushings intersect at a point above the center of gravity of the power head.

5. The mounting system as defined in claim 4 wherein each said bushing has an axis of elasticity, and said axes of elasticity of at least two of said bushings intersect at a point at or below the center of gravity of the power head.

6. The mounting system as defined in claim 3 wherein said connecting means includes a pair of bushings disposed at a fore end of said adaptor plate, and at least one bushing disposed proximate to an aft end of said adaptor plate.

7. The mounting system as defined in claim 3 wherein said connecting means includes a pair of adaptor plate mounting brackets located at a fore end of said adaptor plate, each said bracket being constructed and arranged to secure one of said bushings thereto in an angled relationship when viewed from said fore end of said plate.

8. The mounting system as defined in claim 7 wherein each said bushing has a longitudinal axis, and said mounting brackets are angled so that upon one of said bushings being mounted thereto, said longitudinal axes will intersect above a horizontal line extending fore and aft of a center of gravity of the power head.

9. The mounting system as defined in claim 8 wherein each said bushing mounted at said fore end of said plate has an axis of elasticity, and said axes of elasticity of said bushings intersect at a center of elasticity located at or below the center of gravity of the power head.

10. An adaptor plate for use in coupling a power head to a jet propulsion pump unit having a fore end and an aft end, comprising:

said adaptor plate having a fore end corresponding to the fore end of the pump unit, and an aft end corresponding to the aft end of the pump unit, and power head attachment means for accommodating the power head;

a pair of first adaptor plate mounting brackets disposed in spaced relationship along said one of said fore and aft ends of said plate;

at least one second adaptor plate mounting bracket displaced from said first mount brackets toward said end of said pump unit opposite said end at which said first brackets are located, said first pair of adaptor plate mounting brackets are mounted to said plate at an inclined angle relative to said adaptor plate; and at least one resilient bushing attachable to said first and second brackets for connection of said adaptor plate to the pump unit, so that upon the attachment of the power head to said adaptor plate, vibrations generated by the power head are absorbed by the bushings and isolated from the pump unit.

11. The plate as defined in claim 10 wherein said first pair of adaptor plate mounting brackets are inclined to define a general "V"-shaped orientation when viewed from said fore end of said plate.

12. The plate as defined in claim 10 further including muffler mount means for accommodating a muffler.

13. The plate as defined in claim 12 further including an upper surface, and a lower surface maintained in vertically spaced relationship from said upper surface by a sidewall and defining a passageway in fluid communication with said muffler mount means.

14. The plate as defined in claim 13 further including an exhaust conduit in fluid communication with said muffler mount means.

15. The plate as defined in claim 14 wherein said power head attachment means is in fluid communication with said passageway.

16. The plate as defined in claim 14 wherein said aft motor mount bracket is located in close proximity to said exhaust conduit.

17. An adaptor plate for use in coupling a power head to a jet propulsion pump unit having a fore end, and an aft end, comprising:

a generally planar upper surface defined by said plate and having a fore end corresponding to the fore end of the pump unit, and an aft end corresponding to the aft end of the pump unit;

a pair of fore mounting brackets disposed in spaced relationship along said fore end of said plate, said fore mounting brackets being inclined relative to said planar upper surface;

an aft mounting bracket displaced from said fore mounting brackets toward said aft end of said pump unit; and a resilient bushing attachable to each of said fore and aft mounting brackets for connection of said adaptor plate to said pump unit, so that upon the attachment of the power head to said adaptor plate, vibrations generated by the power head are absorbed by the bushings and isolated from the pump unit.

* * * * *